United States Patent [19]

Smart et al.

[11] Patent Number: 4,988,028

[45] Date of Patent: Jan. 29, 1991

[54] AUTOMATIC RIVETING MACHINE

[75] Inventors: Charles F. Smart; Raymond H. Varian, both of Danbury; Anthony D'Aquila, Trumbull, all of Conn.

[73] Assignee: Emhart, Inc., Towson, Md.

[21] Appl. No.: 445,076

[22] Filed: Dec. 1, 1989

[51] Int. Cl.[5] ..... B21J 15/10

[52] U.S. Cl. ..... 227/3; 227/53; 227/116

[58] Field of Search ..... 227/116, 118, 53, 2, 227/3, 5; 72/11

[56] References Cited

U.S. PATENT DOCUMENTS

| | | | |
|---|---|---|---|
| 3,946,926 | 3/1976 | Willis | 227/112 |
| 4,747,294 | 5/1988 | Schwartz et al. | 72/391 |
| 4,754,643 | 7/1988 | Weeks, Jr. et al. | 72/391 |

*Primary Examiner*—Hien H. Phan
*Assistant Examiner*—John M. Husar
*Attorney, Agent, or Firm*—Spencer T. Smith

[57] ABSTRACT

An automatic riveting machine is disclosed which counts the rivets, as set, to control the feeding of rivets from a feeder to the rivet track or chute. The track will be resupplied after a selected number of rivets are set or sooner should the track become prematurely empty by removal of rivets from the track.

3 Claims, 3 Drawing Sheets

AUTOMATIC RIVETING MACHINE

The present invention relates to automatic riveting machines such as disclosed in U.S. Pat. Nos. 4,747,294 and 4,754,643 and more particularly to the rivet feeding structure of such machines.

Rivet feed systems normally present rivets in single file (parallel to one another) in a feed track or chute which is periodically supplied by a rivet feeder bowl. It is undesirable to stack rivets beyond a selected height and a sensor is used to terminate supply from the feeder bowl once rivets are stacked to this height. The feeder bowl turns on after a predetermined number of rivets have been set. Since an operator may, from time to time, remove rivets from the feed chute, the feed chute may be empty before the next scheduled refilling and this impacts against the productivity of the system.

It is accordingly an object of the present invention to minimize the time when the feed track is empty.

Other objects and advantages of the present invention will become apparent from the following portion of this specification and from the accompanying drawings which illustrate in accordance with the mandate of the patent statutes, a presently preferred embodiment incorporating the principles of the invention.

Figure 1:
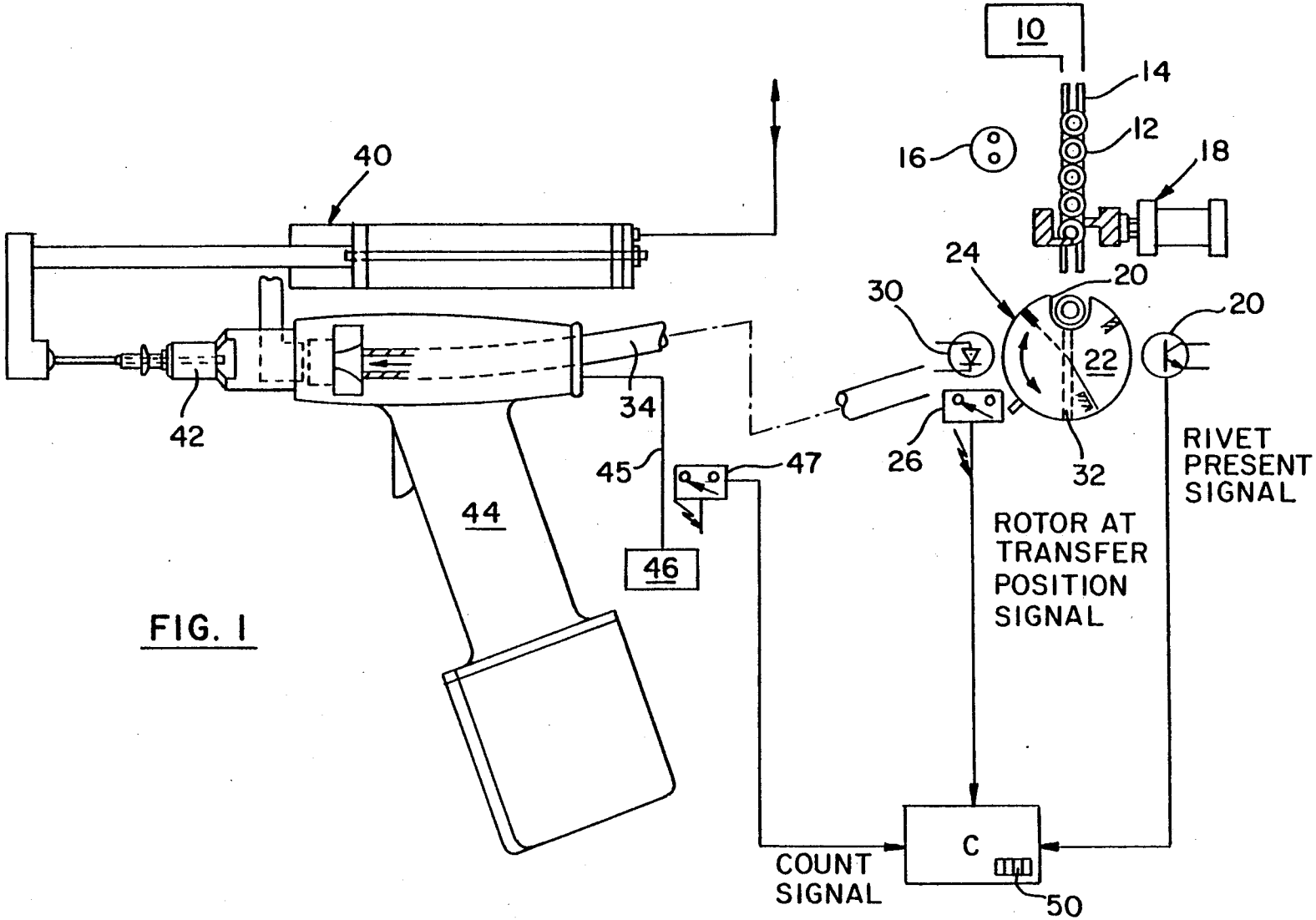
FIG. 1 is a schematic representation of a portion of an automatic riveting machine made in accordance with the teachings of the present invention.
Figure 2:
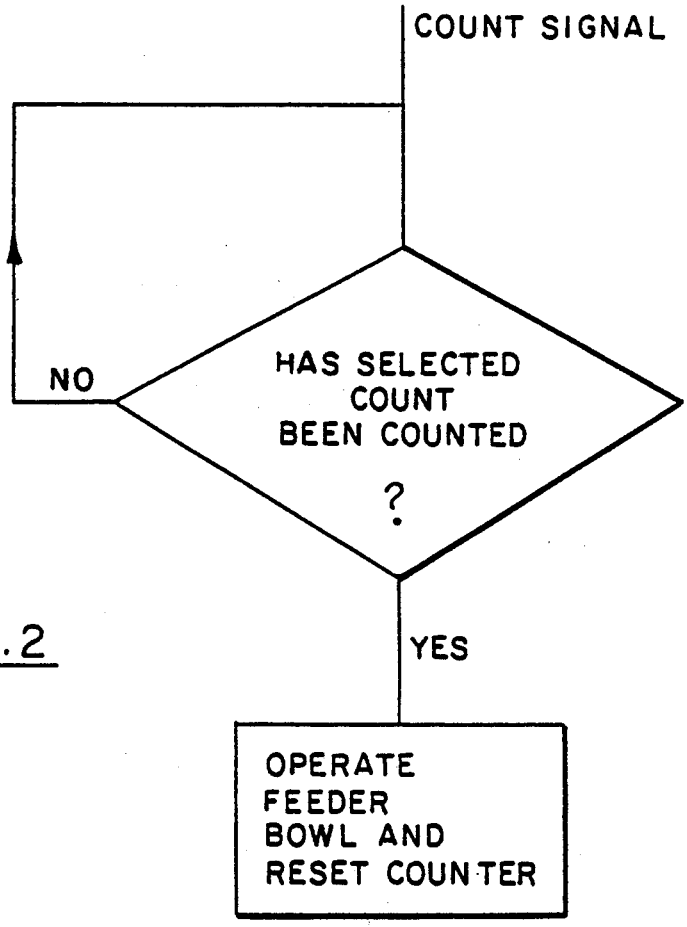
FIG. 2 is part of a flow chart illustrating the control of rivet feed to the feed track of the automatic riveting machine illustrated in FIG. 1.
Figure 3:
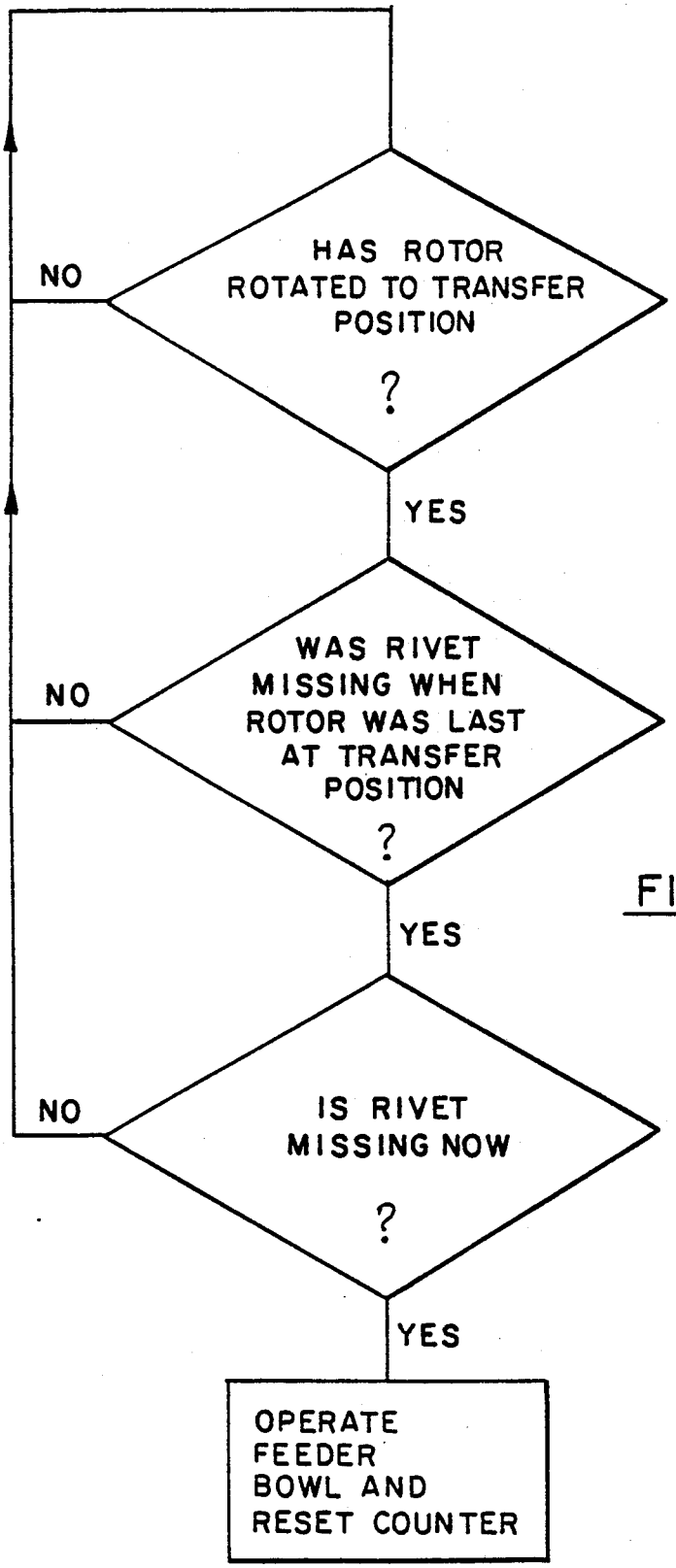
FIG. 3 is another part of the flow chart illustrating the control of rivet feed to the feed track.

A feed bowl 10 containing a supply of rivets 12 will feed rivets, one at a time, in parallel orientation, to a feed track or chute 14. A proximity sensor 16 senses when rivets have been stacked to a selected height and generates a signal to terminate feed bowl 10 operation (by the time the feed bowl stops a few additional rivets will been delivered to the feed track). Rivets will be released, one at a time, from the feed track 14 by a gating mechanism 18 and will be received within an axial channel 20 defined in the cylindrical rotor 22 of an escapement mechanism 24.

The rotor indexes 90 degrees from its receiving orientation to its transfer orientation (sensed by a proximity switch 26 which issues a Rotor At Transfer Position Signal) and the presence of a rivet in the axial channel 20 at the transfer location is confirmed by a light sensor 28 which will go dark as a result of the rivet blocking light transmission from a light source 30 through a diametral bore 32 in the rotor and which will issue a Rivet Present Signal. Air under pressure is then connected to the rotor to blow the rivet through the rivet feed tube 34 to the nesting bushing 36 of the retracted pivot arm 38 (shown in phantom) of the presenting device 40. The nesting bushing 36 is under a vacuum which pulls the rivet into the bushing. The arm 38 is extended and pivoted to the illustrated feed position whereupon the vacuum is removed and pressure is applied to blow the rivet into the nose 42 of the rivet tool 44. When the tool is operated the spent mandrel passes through the mandrel collection tube 45 into a collection box 46. A proximity switch 47 senses the exiting of the spent mandrel from the collection tube into the collection box and generates a Count Signal which indicates that a rivet has been set.

In operation a controller C controls the operation of the feeder bowl 10 to supply rivets to the feed track 14. The operator sets a selected number(X) on an input 50 and every time the controller counts this number of rivets the controller will issue an Operate Feeder Bowl Signal to operate the feeder bowl until the track fills to the desired level. Even though the operator has not set X rivets, if the feed track 12 is empty the controller will operate the feeder bowl and reset the counter. In that event the controller will not receive a Rivet Present Signal when it receives a Rotor At Transfer Position Signal and will return the rotor to its receiving position. Photos verify that the rotor is at the receiving position. The gate will again be operated, but since there are no rivets in the chute, no rivet will be fed to the rotor. When the rotor is again indexed to the transfer position the controller will, for the second successive time, not receive a Rivet Present Signal when it receives a Rotor At Transfer Position Signal. The controller now concludes that the chute is empty and actuates the feeder bowl by issuing an Operate Feeder Bowl Signal. After a set delay, sufficient to allow rivets to begin falling into the track, the rotor will again index to receive a rivet to be transferred.

The rotor will now make 3 attempts to receive a rivet to be transferred. If it still does not receive a rivet present signal when it receives a Rotor At Transfer Position Signal it will signal the suitable fault to the operator and terminate the operating cycle.

What is claimed is:

1. A rivet setting machine comprising
   - a rivet tool for setting rivets,
   - means for counting the number of rivets set by said rivet tool,
   - means for supplying rivets to said rivet tool including
     - a rivet track for supporting parallel rivets in single file,
     - feeder means for feeding rivets to said rivet track,
     - gating means for releasing rivets from said rivet track, one at a time, and
     - means for determining that said feeder track is empty,
     - means for actuating said feeder means either when a selected number of rivets has been counted by said counting means or when said counter has counted a lesser number of rivets but said determining means determines that said rivet is empty.

2. A rivet setting machine according to claim 1, further comprising
   - escapement means for receiving a released rivet,
   - means for displacing said escapement to displace the received rivet from a rivet receiving position to a transfer position and
   - said determining means comprising means for determining whether a rivet is held by said escapement means when said escapement means is at said rivet transfer position.

3. A rivet setting machine according to claim 2, further comprising
   - means for displacing said escapement means to said rivet receiving position when said determining means determines that a rivet is not held by said escapement means at said transfer position, and
   - means for again operating said gating means and displacing said escapement means to displace a received rivet from said receiving position to said transfer position,
   - said actuating means actuating said feeder means when said determining means determines for the second successive time that no rivet is held by said escapement means at said transfer position.

* * * * *